United States Patent [19]

Shaw et al.

[11] 4,058,965

[45] Nov. 22, 1977

[54] OPEN-END SPINNING MACHINES

[75] Inventors: Jack Shaw, Read near Burnley; Bruce Ellingham, Brierfield, both of England

[73] Assignee: Platt Saco Lowell Limited, Rossendale, England

[21] Appl. No.: 590,859

[22] Filed: June 27, 1975

[30] Foreign Application Priority Data

July 3, 1974 United Kingdom ..... 29500/74

[51] Int. Cl.[2] ..... D01N 1/12

[52] U.S. Cl. ..... 57/58.91; 19/112

[58] Field of Search ..... 57/58.91, 58.95; 19/97, 19/112

[56] References Cited

U.S. PATENT DOCUMENTS

| | | | |
|---|---|---|---|
| 3,123,866 | 3/1964 | Stewart et al. | 19/97 |
| 3,210,923 | 10/1965 | Schlossen | 57/58.95 |
| 3,381,463 | 5/1968 | Fajt et al. | 57/58.95 |
| 3,624,994 | 12/1971 | Robleva et al. | 57/58.91 |
| 3,730,802 | 5/1973 | Stewart et al. | 19/112 |
| 3,737,951 | 6/1973 | Mackie | 19/97 |
| 3,750,381 | 8/1973 | Greenwood et al. | 57/58.91 |
| 3,757,506 | 9/1973 | Kutscher et al. | 57/58.95 |
| 3,828,539 | 8/1974 | Crousdale et al. | 57/58.91 |
| 3,834,145 | 9/1974 | Ellingham et al. | 57/58.95 X |
| 3,841,075 | 10/1974 | Kutscher et al. | 57/58.91 |

*Primary Examiner*—Richard C. Queisser
*Assistant Examiner*—Charles Gorenstein

[57] ABSTRACT

The present disclosure is directed to an open-end spinning machine for the open-end spinning of textile fibers, in which there are provided a spinning element, a fiber opening roller, means for feeding fibers in the form of a sliver to said opening roller, and fiber conveying means for conveying in discrete form to said spinning element fibers opened by said opening roller. The opening roller comprises a boss portion, an end wall portion extending radially outwardly from said boss portion at one end thereof, and a cylindrical shell portion extending from said wall portion over and in coaxial relation to said boss portion to form an annular cavity between the outer surface of said boss portion, the inner surface of said wall portion and the inner surface of said shell portion. A plurality of fiber engaging pins are located in holes in said shell portion, the pins passing from within the annular cavity through the shell portion and having end portions terminating in points protruding from the outer surface of the shell portion.

15 Claims, 7 Drawing Figures

OPEN-END SPINNING MACHINES

The present invention relates to open-end spinning machines and is particularly concerned with improvements in the construction of opening rollers for use therein.

In an open-end spinning machine hitherto proposed sliver is fed to a rotating opening roller which opens the sliver into separated fibres and conveys them to the entrance of a fibre feed duct. At this point the fibres are removed from the opening roller and conveyed in discrete form in an airstream down the fibre feed duct to the interior of a rotating spinning rotor. The fibres accumulate on the fibre collecting surface of the spinning rotor and are twisted into the tail end of a yarn which is withdrawn from the rotor by yarn delivery means and collected on a yarn package.

It is very important for successful yarn production that opening of the sliver is carried out efficiently by the opening rollers.

In an opening roller construction hitherto proposed a card type wire provided with saw type teeth is wound helically around the cylindrical outer surface of the roller. It has however been found that rollers of this construction possess certain disadvantages. In particular, when processing certain fibres, particularly when processing blends of natural and synthetic fibres, the working life of the card type wire has proved very short, necessitating frequent maintenance. Furthermore, it has been found that the opening rollers of this construction have the disadvantage that many fibre trapping points are formed in which fibres can become lodged, thus impairing the efficiency of the opening action.

In a further opening roller hitherto proposed the construction has included the provision of needles or pins around the outer surface of the roller. It has, however, been found difficult to devise a suitable roller construction of this type which meets the requirements of ease of manufacture whilst providing a roller with a satisfactory operating surface.

According to the present invention, there is provided an opening roller for an open-end spinning machine comprising a boss portion, an end wall portion extending radially outwardly from said boss portion at one end thereof, a cylindrical shell portion extending from said wall portion over and in coaxial relation to said boss portion to form an annular cavity between the outer surface of said boss portion, the inner surface of said wall portion and the inner surface of said shell portion, and a plurality of fibre engaging pins located in holes, said pins passing from within the annular cavity through the shell portion and having end portions terminating in points protruding from the outer surface of the shell portion.

Figure 1:
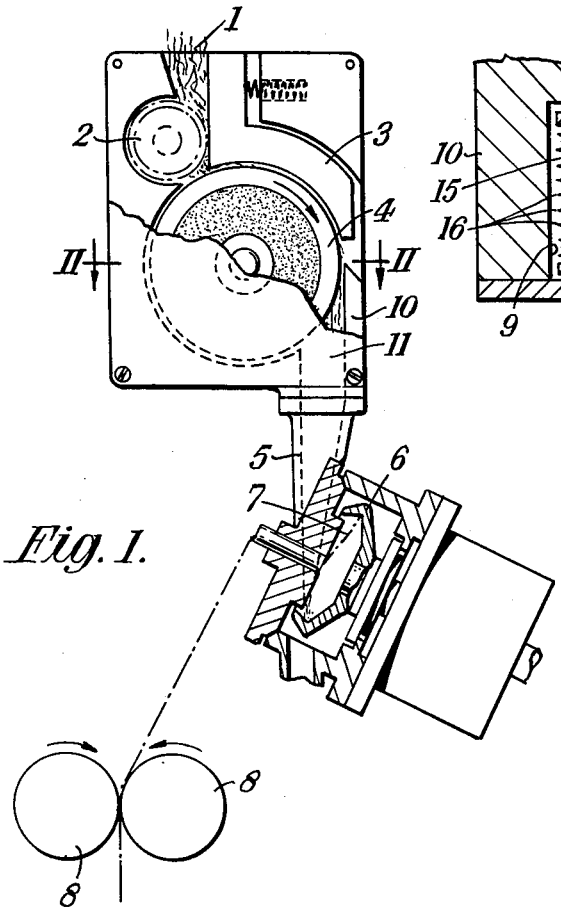
Figure 2:
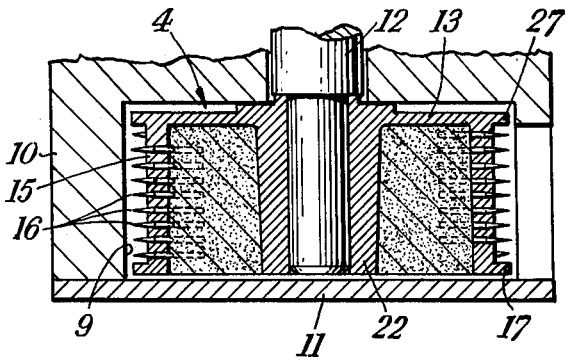
Figure 3:
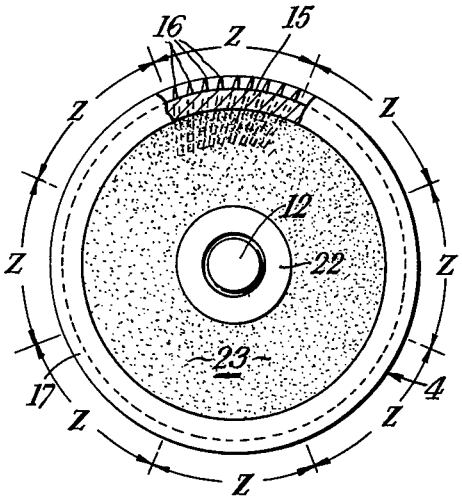
Figure 4:
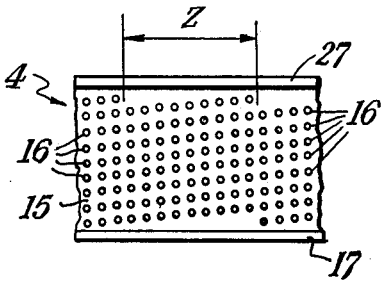
Figure 5:
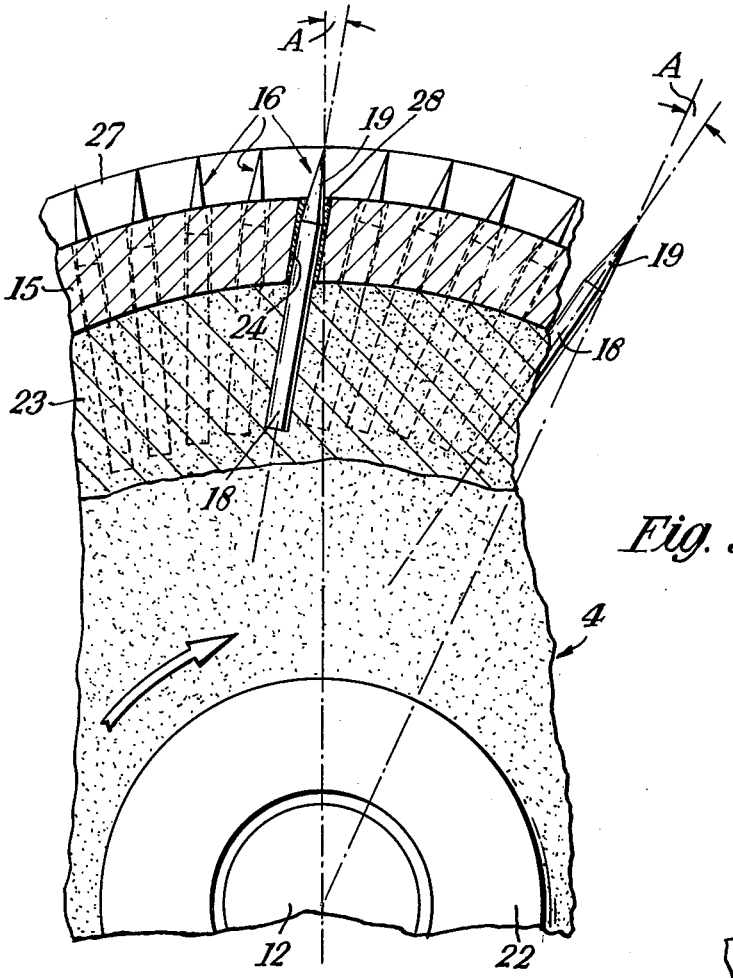
Figure 6:
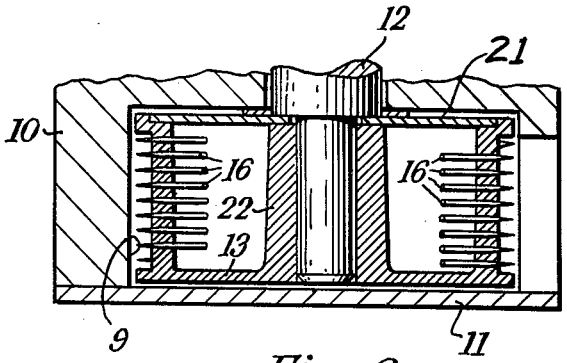
Figure 7:
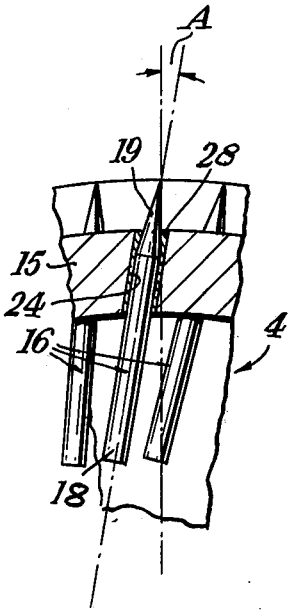

Two embodiments of the invention will now be described by way of example with reference to the accompanying drawings, in which:

FIG. 1 is a diagrammatic side elevation of an open-end spinning machine incorporating an opening roller according to a first embodiment of the present invention, FIG. 2 is a cross-sectional plan view of part of the machine shown in FIG. 1, taken on the line II — II in FIG. 1 and showing the construction of the opening roller, FIG. 3 is a side elevation partly in section and to an enlarged scale of the opening roller shown in FIG. 1, FIG. 4 is a developed plan of part of the periphery of the roller shown in FIG. 1 illustrating the formation of holes therein, FIG. 5 is a part cross-sectional side elevation of a fragment of the roller shown in FIG. 1, FIG. 6 is a cross-sectional plan view of a part of an opening roller according to a second embodiment of the invention, and FIG. 7 is a cross-sectional side elevation of a fragment of the opening roller shown in FIG. 6.

Referring firstly to FIG. 1, a sliver 1 is forwarded by a nip formed between a feed roller 2 and a feed pedal 3 biased by spring pressure toward the feed roller 2. The sliver emerging from the nip passes to a rotating opening roller 4 which subjects it to an opening action and which conveys the fibres separated from the sliver to the entrance of a fibre feed duct 5. An airstream set up in the fibre feed duct 5 conveys the fibres in discrete form to the interior of a rotating spinning rotor 6. The fibres accumulate at the maximum internal diameter of the spinning rotor 6 where they are twisted into the tail end of a yarn 7 and withdrawn by a pair of delivery rollers 8 and wound on to a package (not shown).

Referring now to FIG. 2, the opening roller 4 is mounted within a cavity 9 formed in a housing 10. A cover 11 covers the open end of the cavity. The opening roller 4 is fixedly mounted on one end of a shaft 12 mounted for rotation in suitable bearings (not shown). The opening roller 4 has a boss portion 22, an end wall 13 extending radially from one end of the boss portion to form an end face of the roller and a cylindrical shell portion 15 which provides a location for a plurality of pins 16 which pass through holes in the shell portion 15. Flanges 17 and 27 extend radially from the shell portion 15 at the ends thereof.

The cavity formed in the opening roller 4 between the shell portion 15, the end wall 13 and the boss portion 22 is filled with a plastics filler 23 to provide a smooth end face for the opening roller and enhance the balancing characteristics of the roller.

At best seen in FIG. 5, each pin 16 is located in the shell portion 15 of the roller in a mounting hole 24 in which it is a clearance fit and in which it is secured by the synthetic resin 28 which fills the clearance between the pin 16 and the hole 24. Each pin 16 is formed by a body portion 18 of constant circular cross-section and a tapering porton 19 protruding from the outer surface of the shell portion 15 and terminating in a point. The extent of protrusion of the pins 16 corresponds to the extent of protrusion of the flanges 17 and 27. The junction of the body portion 18 and the tapering porton 19 is set below the outer surface of the shell porton 15.

As will be seen in FIG. 5, each pin 16 is forwardly inclined with respect to the direction of rotation indicated by the arrow. The angle A subtended between the leading edge of the tapering portion of the pin and a radial line passing through the pointed end of the pin is determined by the fibres being processed. For example, it has been found that a suitable angle A for processing certain fibres is 10° and for processing cotton the angle A may be 20°. For processing certain other fibres the pins 16 may be radially arranged or backwardly inclined with respect to the direction of the rotation of the opening roller to provide angle A with a zero or negative value.

In the preferred method of construction of the roller the pins 16 are inserted in the holes and held in position therein while the clearances are filled with resin 28, which is then allowed to set. Thereafter, the annular cavity in the roller is filled with a plastics filler 23. Accurate location of the ends of the pins 16 necessary for satisfactory opening of a sliver is thus obtained.

The employment of pins as the means to open the sliver enables a better distribution of points of the working surface of the roller than is possible with the former arrangement utilising card type wire. An example of pin distribution is seen in FIGS. 3 and 4, where eight zones Z are provided extending contiguously around the circumference of the shell portion 15 as represented in FIG. 3, each zone having an array of pins as illustrated in FIG. 4. The pins are arranged in rows parallel to the rotary axis of the roller with eight pins in each row spaced at 10 points per inch. Around the circumference of the shell portion 15 there are nine rows of pins spaced at 10 rows per inch in each zone in which the pins of each row are offset from the pins in the preceding or succeeding row.

The filler 23 used is coloured according to a predetermined colour code to indicate a particular setting or distribution of pins so that removal of the cover 11 enables a ready visual check to be made of the type of opening roller on the machine.

In a further embodiment of the invention shown in FIGS. 6 and 7, the pins 16 are mounted in holes 24 in the same manner and disposition as that of the pins 16 of the roller 4 shown in FIGS. 1 to 5. The filler 23 is, however, omitted and an annular cover plate 21 is used to cover the cavity of the opening roller and as shown forms a planar end face to the roller.

What we claim as our invention and desire to secure by Letters Patent is:

1. In an open end spinning machine for the open end spinning of textile fibres, comprising, a spinning element, a rotatable fibre opening roller, means for feeding fibres in the form of a sliver to said opening roller, fibre conveying means for conveying in discrete form to said spinning element fibres opened by said opening roller, said opening roller comprising a boss portion, an end wall portion extending radially outwardly from said boss portion at one end thereof, a cylindrical shell portion extending from said wall portion over and in coaxial relation to said boss portion to form an annular cavity between an outer surface of said boss portion, an inner surface of said wall portion and an inner surface of said shell portion, said shell portion having a plurality of holes therein and a plurality of fibre engaging pins located in the holes, said pins passing from within the annular cavity and having end portions terminating in points protruding from the outer surface of the shell portion, wherein a plastic filler material fills the cavity in the roller and forms a planar end face to the roller.

2. In an open-end spinning machine, an opening roller according to claim 1, wherein a radially extending flange projects from an outer surface of said shell portion, said pins having end portions terminating in points protruding from the outer surface of the shell portion to the same radial extent as the radially extending flange.

3. In an open-end spinning machine, an opening roller according to claim 2, wherein the holes are each of a first predetermined size which is greater than the size of each said pins to thereby define clearances therebetween, said pins being secured in position by a fixing agent which fills the clearances.

4. In an open end spinning machine, an opening roller according to claim 2, wherein said shell portion has another radially extending flange projecting from the outer surface at an end opposite said one end thereof, said another flange forming with said one flange and the outer surface of the shell portion an annular recess into which the pins protrude.

5. In an open end spinning machine, an opening roller according to claim 3, wherein each of the pins has a constant cross-section body portion and wherein each said end portion tapers to said point.

6. In an open end spinning machine, an opening roller according to claim 5, wherein each said end portion is of conical formation.

7. In an open end spinning machine, an opening roller according to claim 6, wherein the body portion and the end portion of each pin forms a junction which lies inwardly of the outer surface of the shell portion.

8. In an open end spinning machine, an opening roller according to claim 7, wherein each said pin is forwardly inclined with respect to the direction of rotation of the roller.

9. In an open end spinning machine, an opening roller according to claim 1, wherein the leading edge of the end portion of each said pin coincides with a radial line of said roller passing through said point of the pin.

10. In an open end spinning machine, an opening roller according to claim 1, wherein the angle subtended between the leading edge of the end portion of each said pin and the radial line passing through said point of the pin is at least 10°.

11. In an open end spinning machine, an opening roller according to claim 10, wherein the angle is 20°.

12. In an open end spinning machine, an opening roller according to claim 1, wherein the pins form an array in each of a plurality of discrete zones disposed continuously about the circumference of the shell portion, the pins in each said array being arranged in a plurality of rows parallel to the rotary axis of the roller, and the pins of each row being offset from the pins in the preceding and succeeding row.

13. In an open end spinning machine, an opening roller according to claim 1, wherein said plastic filler material comprises a synthetic resin.

14. In an open end spinning machine, an opening roller according to claim 1, wherein the filler is colored according to a predetermined color code to indicate a particular setting or distribution of pins.

15. An opening roller arrangement comprising a roller housing having a removable cover and an opening roller according to claim 1, a drive shaft on one end of which said opening roller is fixedly mounted in such manner in the housing that the roller cavity which is filled with the filler material is exposed upon opening of the housing cover.

* * * * *